US005727352A

United States Patent [19]

Bared et al.

[11] Patent Number: 5,727,352

[45] Date of Patent: Mar. 17, 1998

[54] PREFABRICATED, TRANSPORTABLE, DRIVE-THRU CONVENIENCE STORE

[75] Inventors: Maurice Bared, Coconut Grove; Al Argenti, Boca Raton; Rebecca Bared, Miami, all of Fla.; Roy Van Doorn, Charlottesville, Va.; Barry Jennings, Largo; Scott Francis, Clearwater, both of Fla.

[73] Assignee: REWJB Dairy Plant Associates, Miami, Fla.

[21] Appl. No.: 358,873

[22] Filed: Dec. 19, 1994

[51] Int. Cl.[6] ..... E04H 1/00

[52] U.S. Cl. ..... 52/79.1; 52/36.2; 52/33

[58] Field of Search ..... 186/35, 36, 52–54, 186/57, 59; 52/33, 36.1, 36.2, 79.1, 234

[56] References Cited

U.S. PATENT DOCUMENTS

| | | | |
|---|---|---|---|
| 1,242,872 | 10/1917 | Saunders | 186/52 X |
| 1,494,390 | 5/1924 | Stevenson | 186/52 X |
| 1,751,199 | 3/1930 | Grant | 186/53 |
| 1,882,488 | 10/1932 | Ellis | 186/57 |
| 2,096,959 | 10/1937 | Clerc | 186/57 |
| 2,242,811 | 5/1941 | Bowers | 186/57 |
| 2,638,636 | 5/1953 | Pool . | |
| 3,282,382 | 11/1966 | Thompson . | |
| 3,348,634 | 10/1967 | Hitchins | 52/79.1 |
| 3,437,177 | 4/1969 | Close | 186/52 |
| 3,647,026 | 3/1972 | Alexander et al. | 186/53 |
| 3,836,220 | 9/1974 | Ishammar . | |
| 3,856,115 | 12/1974 | Stangel | 186/52 |
| 3,866,364 | 2/1975 | Pollard . | |
| 3,866,365 | 2/1975 | Honigman . | |
| 4,006,798 | 2/1977 | De Mund . | |
| 4,154,027 | 5/1979 | Searcy | 186/52 X |
| 4,236,359 | 12/1980 | Woolford . | |
| 4,704,827 | 11/1987 | Murphy et al. . | |
| 4,715,159 | 12/1987 | Hijazi . | |
| 4,733,754 | 3/1988 | Acosta . | |
| 5,036,638 | 8/1991 | Kurtz | 52/79.1 X |
| 5,052,519 | 10/1991 | Woodham . | |
| 5,070,661 | 12/1991 | Lo Guidici . | |
| 5,109,956 | 5/1992 | Casale et al. . | |
| 5,113,974 | 5/1992 | Vayda . | |
| 5,285,604 | 2/1994 | Carlin . | |

*Primary Examiner*—Carl D. Friedman
*Assistant Examiner*—Beth A. Aubrey
*Attorney, Agent, or Firm*—Lott & Friedland, P.A.

[57] ABSTRACT

A modular convenience store. The store has a floor and a plurality of walls extending substantially vertically from the floor, which define a perimeter of the store, which has an interior and exterior. This plurality of walls includes a front wall, a rear wall, a left wall, and a right wall. The front wall is less than or equal to sixty feet long. The rear wall is less than or equal to sixty feet long and substantially opposing the front wall. The left wall is less than or equal to fourteen feet long, and the right wall is less than or equal to fourteen feet long and substantially opposing the left wall. A roof covers the interior of the store. A front door is substantially intermediate the front wall, and a rear door is substantially intermediate the rear wall. A walk-in cooler, with an interior, is located within the interior of the store, adjacent the left and rear walls, left of the rear door, and spaced from the front wall. An exterior cooler-service door is provided for passage directly between the exterior of the store and the interior of the cooler. An interior cooler-service door is provided for passage between the interior of the cooler and the interior of the store. The store is assembleable off-site and transportable as a single unit.

50 Claims, 6 Drawing Sheets

PREFABRICATED, TRANSPORTABLE, DRIVE-THRU CONVENIENCE STORE

TECHNICAL FIELD

This invention relates generally to convenience stores, and this invention specifically relates to prefabricated, modular, transportable, drive-thru convenience stores featuring ergonomic layouts allowing for maximum efficiency, profitability, and customer service.

BACKGROUND OF THE INVENTION

In the drive-thru industry, which allows consumers to access a variety of services from the convenience of their vehicles, numerous factors play a role in the design of the structures from which the services are provided. Among the factors considered in designing drive-thru structures are employees' access to products selected by consumers for purchase; storage area available for inventory; security, in terms of protecting both the establishment's inventory, the employees, and the customers from criminal elements; the ability to display a "menu" of available products to consumers as they approach the structure's service facility (the "drive-thru window"); the ability to efficiently rotate inventory supplies; maintaining an efficient flow of customer vehicle traffic; and the ability to fulfill the foregoing goals while lawfully abiding by all relevant government regulations, such as local zoning laws and the federal Americans with Disabilities Act ("ADA").

Additionally, certain factors exist which are peculiar to drive-thru establishments providing convenience store-type services, such as, for example, the need for a large volume of refrigerated storage; the ability to efficiently deliver and rotate short-life perishable supplies, such as dairy products; the ability to display actual products to customers; and the ability to provide efficient service to customers by delivering their purchases to the driver's side of vehicles.

Finally, prefabrication, modularity, and transportability are advantageous features of drive-thru convenience stores, for a number of reasons. First, in situations where convenience store owners do not own the land on which they build their stores, termination of the lease results in the loss of the structure to the landlord, who then may lease the structure to another tenant. If the convenience store owner's structure constitutes proprietary trade dress, the convenience store owner must then ask the landlord or subsequent tenants to alter the structure so as to avoid infringement of the trade dress or, alternatively, the convenenience store owner is placed in the position of having to bring an infringement action in order to protect its trade dress rights. Where the structure is modular and the lease includes the appropriate terminology, the convenience store owner may simply transport the structure to an alternative location upon termination of the lease. Additionally, because federal Department of Transportation regulations come into play when modular structures are transported, certain size limitations apply. For instance, the maximum width of a structure to be transported on federal roadways is 14 feet. Because of such restrictions, modular convenience stores must utilize any available space in the most economical manner feasible.

Previous attempts have been made to design ergonomically designed, prefabricated, modular, transportable buildings, certain features of which are generally described in U.S. Pat. No. 5,285,604, to Carlin; U.S. Pat. No. 5,113,974, to Vayda; U.S. Pat. No. 5,109,956, to Casale et al.; U.S. Pat. No. 5,070,661, to Lo Guidici; U.S. Pat. No. 5,052,519, to Woodham; U.S. Pat. No. 4,733,754, to Acosta; U.S. Pat. No. 4,715,159, to Hijazi; U.S. Pat. No. 4,704,827, to Murphy et al.; U.S. Pat. No. 4,236,359, to Woolford; U.S. Pat. No. 4,006,798, to De Mund; U.S. Pat. No. 3,866,365, to Honigtmm; U.S. Pat. No. 3,866,364, to Pollard; U.S. Pat. No. 3,836,220, to Ishammar; U.S. Pat. No. 3,282,382, to Thompson; and U.S. Pat. No. 2,638,636, to Pool, all of which are incorporated herein by reference. However, none of these references, either alone or in combination with others, describes a modular convenience store with these ergonomic features.

Additionally, Champion Modular Restaurant Corporation has constructed modular drive-thru fast-food restaurants identified by the "CHECKERS" trademark. However, because of the distinct, ergonomic needs of a drive-thru convenience store, none of which are described in the above-listed references, either alone or in combination, the design of the modular drive-thru fast-food restaurants does not fulfill the needs of a design for a modular drive-thru convenience store.

Thus, there is a need in the art for an ergonomically-designed workplace for use in space-constrained convenience stores.

There is an additional need in the art for such convenience stores to feature drive-thru access.

There is an additional need in the art for these drive-thru convenience stores to be modularly constructed.

There is an additional need in the art for modularly constructed drive-thru convenience stores featuring an ergonomically-designed workplace to be transportable from location to location.

SUMMARY OF THE INVENTION

The invention provides a drive-thru convenience store having an ergonomically-designed workspace. The invention further provides a prefabricated, modular convenience store having such a design.

Broadly stated, the present invention provides a convenience store including a floor; a plurality of walls extending substantially vertically from the floor and defining a perimeter of the store, the store having an interior and exterior; a roof covering the interior of the store; at least one access door for ingress to and egress from the interior of the store; a walk-in cooler having an interior, the cooler being located within the interior of the store adjacent at least one of the walls; an exterior cooler-service door for passage between the exterior of the store and the interior of the cooler; an interior cooler-service door for passage between the interior of the cooler and the interior of the store; and at least one display window disposed within at least one of the walls.

In an alternate embodiment, the plurality of walls includes a front wall; a rear wall; a left wall; and a right wall.

In an alternate form of the present invention, the front and rear walls substantially oppose one another, and the left and right walls substantially oppose one another, so that the store is substantially rectangular in shape.

In an alternate form of the present invention, the access doors include a front access door substantially intermediate the front wall and a rear access door substantially intermediate the rear wall.

In an alternate embodiment, the cooler is located left of the rear access door and spaced from the front wall.

In an alternate form of the present invention, the cooler is adjacent the rear and left walls.

An alternate form of the present invention provides the cooler further with a front side substantially parallel to and spaced apart from the rear and front walls; a right side substantially parallel to and spaced apart from the left and right walls; a left side adjacent the left wall; and a rear side adjacent the rear wall.

In an alternate embodiment, the front side substantially opposes the rear side and the right side substantially opposes the left side so that the cooler is substantially rectangular.

In an alternate form of the present invention, the exterior cooler-service door is disposed within the left side of the cooler.

An alternate embodiment further provides a cooler-product door in the right side of the cooler.

In an alternate form of the present invention, the display windows include a front display window disposed within the front wall to the side of the front access door and a rear display window disposed within the rear wall to the side of the rear access door.

An alternate embodiment further provides an employee room within the interior of the store adjacent the front and right walls, the employee room being located right of the front access door, the employee room being spaced from the rear wall; and a restroom within the employee room.

In an alternate form of the present invention, the store is assembleable off-site and transportable as a single unit.

In an alternate form of the present invention, the cooler has a front side substantially parallel to and spaced apart from the rear and front walls; a right side substantially parallel to and spaced apart from the left and right walls; a left side; and a rear side.

An alternate embodiment provides cooler racks in the interior of the cooler adjacent the cooler product doors.

In an alternate embodiment, the front and rear access doors are sliding glass doors.

An alternate embodiment provides a left display window located in the left wall between the cooler and the front wall; and a right display window located in the right wall between the employee room and the rear wall.

In an alternate form of the present invention, the front display window occupies substantially all of the front wall left of the front access door; the rear display window occupies substantially all of the rear wall right of the rear access door; the left display window occupies substantially all of the left wall between the cooler and the front wall; and the right display window occupies substantially all of the right wall between the employee room and the rear wall.

An alternate embodiment provides a cashier stand located within the interior of the store substantially intermediate between and spaced from the front and rear access doors, the stand being located right of and spaced from the cooler; and an inventory storage area located right of the cashier stand and left of the employee room.

An alternate embodiment provides front display racks adjacent the front and left display windows for displaying merchandise to the exterior of the store through the front and left display windows; and rear display racks adjacent the rear and right display windows for displaying merchandise to the exterior of the store through the rear and right display windows; wherein the cooler is spaced from the front wall sufficiently to allow stocking of the front display racks; wherein the employee room is spaced from the rear wall sufficiently to allow stocking of the rear display racks.

An alternate form of the present invention provides a freezer located within the inventory storage area. An alternate embodiment provides inventory shelving located within the inventory storage area.

An alternate embodiment provides a front canopy and a rear canopy extending from the roof over the front and rear access doors, respectively.

In an alternate embodiment, the left and right walls are less than twenty feet long. More specifically, the left and right walls may be less than or equal to fourteen feet long. In an alternate embodiment, the front and rear walls are less than sixty-five feet long. Further, the front and rear walls may be less than or equal to fifty-five feet long.

An alternate form of the present invention provides an exit-only panic door through the front wall located between the front access door and the employee area.

An alternate form of the present invention provides a modular convenience store having a floor; a plurality of walls extending substantially vertically from the floor and defining a perimeter of the store, the store having an interior and exterior; a roof covering the interior of the store; at least one access door for ingress to and egress from the interior of the store; a walk-in cooler having an interior, the cooler being located within the interior of the store adjacent at least one of the walls; an exterior cooler-service door for passage between the exterior of the store and the interior of the cooler; an interior cooler-service door for passage between the interior of the cooler and the interior of the store; and at least one display window disposed within at least one of the walls; wherein the store is assembleable off-site and transportable as a single unit.

An alternate embodiment provides a modular convenience store having a floor; a plurality of walls extending substantially vertically from the floor and defining a perimeter of the store, the store having an interior and exterior; the plurality of walls including a front wall, a rear wall, a left wall, and a right wall; the front wall being less than or equal to sixty feet long; the rear wall being less than or equal to sixty feet long and substantially opposing the front wall; the left wall being less than or equal to fourteen feet long; the right wall being less than or equal to fourteen feet long and substantially opposing the left wall; a roof covering the interior of the store; a front access door substantially intermediate the front wall; a rear access door substantially intermediate the rear wall; a walk-in cooler having an interior, the cooler being located within the interior of the store, left of the rear access door, and spaced from the front wall; an exterior cooler-service door for passage between the exterior of the store and the interior of the cooler; an interior cooler-service door for passage between the interior of the cooler and the interior of the store; wherein the store is assembleable off-site and transportable as a single unit.

Accordingly, it is an object of the present invention to provide a space-constrained convenience store employing an ergonomically designed workspace.

It is a further object of the present invention to provide such a convenience-store featuring drive-thru access.

It is a further object of the present invention to provide such drive-thru convenience stores with modular constructions.

It is a further object of the present invention to provide such modularly constructed drive-thru convenience stores featuring an ergonomically-designed workspace to be transportable from location to location.

These and other objects, features, and advantages of the present invention may be more clearly understood and appreciated from a review of ensuing detailed description of the preferred and alternate embodiments and by reference to the accompanying drawings and claims.

DETAILED DESCRIPTION OF THE PREFERRED EMBODIMENT

The description of the drawings and the embodiments of the invention is made within the frame of reference established by the drawings. In order to facilitate the understanding of the description and the appended claims, the terms "left", "right", "front", "rear", and the like are used consistently as they apply to this particular frame of reference. In actuality, the invention is not limited to this frame of reference.

The preferred embodiment of this invention is a prefabricated, modular convenience store. However, many of the features of the design are equally applicable to conventional, site-built convenience stores.

Figure 1:
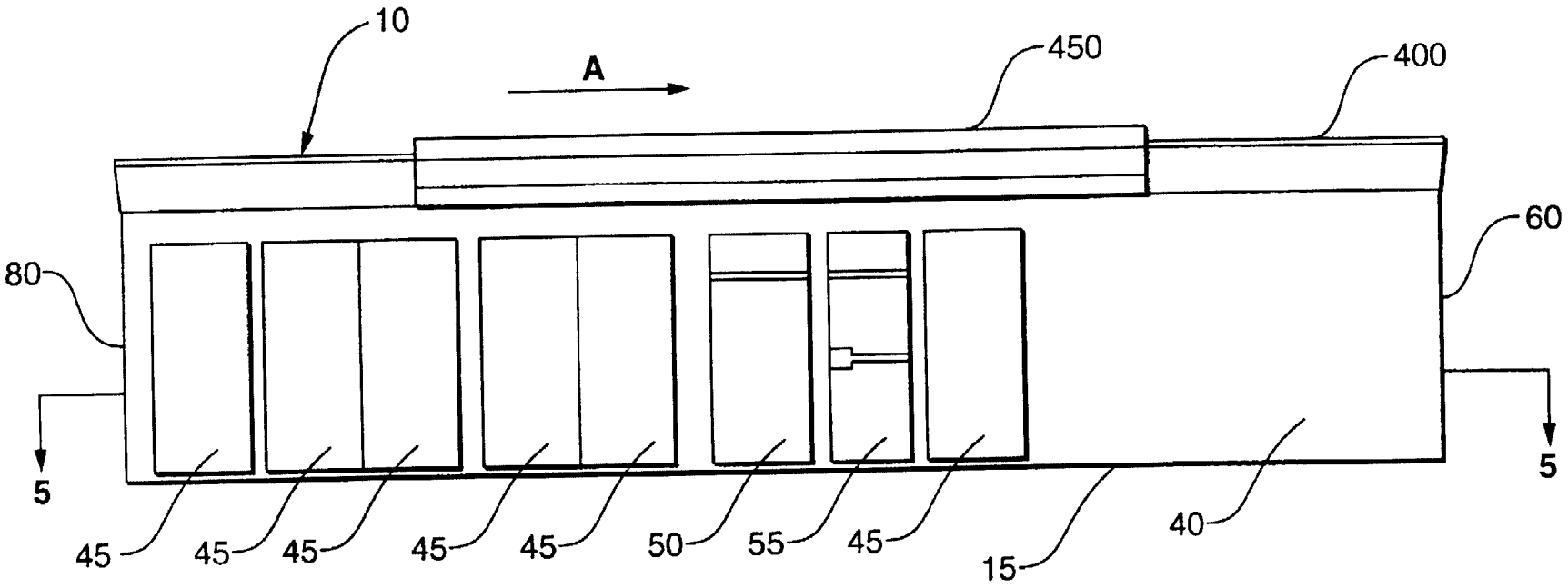
FIG. 1 is a front view of an embodiment of the present invention.

FIG. 1 shows the front view of the preferred embodiment of a store 10. Store 10 has a floor 15 and a front access door 50 (also called "front door") located near the middle of a front wall 40. A customer in his or her vehicle approaches the front door 50 in the direction indicated by the arrow A. This allows the customer to interact with the employees in the store 10 through the driver's side of his or her vehicle. The customer leaves in the same direction.

A series of front display windows 45 are disposed in the front wall 40 to the side of the front door 50 from which the customer approaches. This allows the customer to view whatever is displayed behind the front display windows 45 as he or she approaches the front door 50. In this embodiment, a series of front display windows 45 is employed to substantially occupy the entire front wall 40 to that side of the rear door 30. In actual practice, any number of front display windows 45 could be used. Also, in this embodiment, a front display window 45 is disposed in the front wall 40 to the side of the front door 50 to which the customer will exit. This particular front display window 45 allows a view of more of the inside of the store 10.

A panic door 55 is disposed in the front wall 40 next to the front door 50. This allows for emergency exit should the front door 50 become locked shut. The roof 400 covers the store 10, and front canopy 450, extends out from the roof 400 over the front door 50. Canopy 450 provides shelter to customers being served at front door 50, and also helps to shelter the store 10 itself during inclement weather, because front door 50 generally remains open while the store 10 is in operation. Canopy 450 spans from over front door 50 in each direction toward the left and right walls 80, 60. Front canopy 450 can span either more or less distance in each direction toward the left and right walls 80, 60. A longer span toward the left wall 80 could be employed to provide better shade to prevent direct sunlight from hitting front display windows 45, thereby preventing unwanted solar heating.

Figure 2:
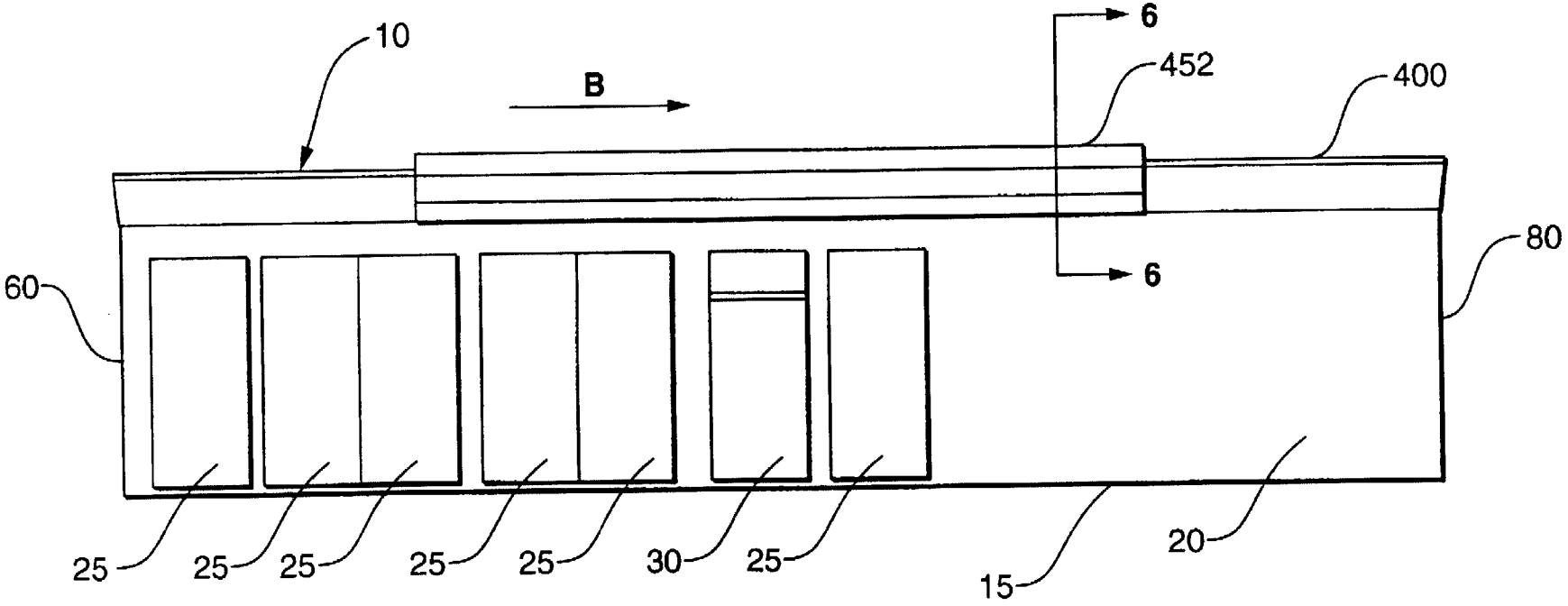
FIG. 2 is a rear view of an embodiment of the present invention.

FIG. 2 shows the rear view of the store 10, and looks very similar to the front view shown in FIG. 1. The similarities reflect the desire to design a store in which both drive-thru lanes can be served equally efficiently. The rear access door 30 (also called "rear door") is located near the middle of rear wall 20. To allow interaction through the driver's side here as well, a customer approaches rear door 30 in the direction indicated by arrow B.

A series of rear display windows 25 are disposed in the rear wall 20 to the side of the rear door 30 from which the customer approaches and substantially occupies the entire rear wall 20 to that side of the rear door 30. Again, any number of rear display windows 25 could be used. Also, in this embodiment, a rear display window 25 is disposed in the rear wall 20 to the side of the rear door 30 through which the customer will exit.

The roof 400 covers the store 10, and rear canopy 452, extends out from the roof 400 over and shelters the rear door 30. As with the front of the store 10, a longer or shorter span toward the right and left walls 60, 80 could be employed.

Figure 3:
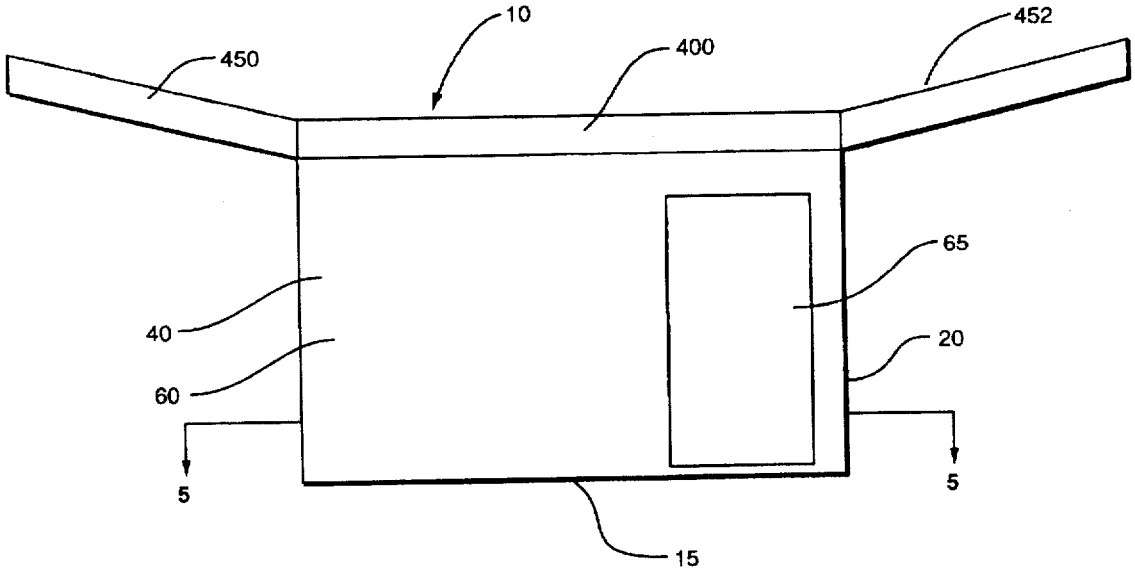
FIG. 3 is a side view of an embodiment of the present invention.

FIG. 3 shows the right view of the present invention. Right display window 65 is disposed in the right wall 60 in the preferred embodiment of the store 10. The roof 400 covers the store. This figure provides a better view of canopies 450, 452 extending out from the roof.

Figure 4:
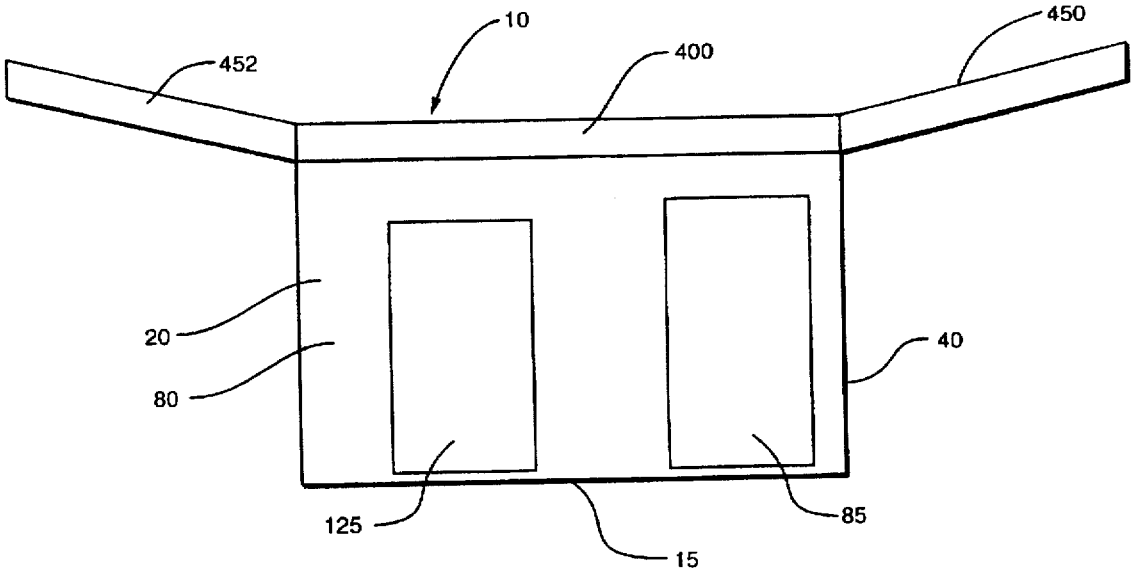
FIG. 4 is a side view of an embodiment of the present invention.

FIG. 4 shows the left view of the preferred embodiment, looking at the opposite end of the store 10. A left display window 85 and an exterior cooler-service door 125 are disposed in the left wall 80. As discussed later, depending upon the configuration of the cooler (not shown in this figure), the exterior cooler-service door 125 may either be disposed directly in the left wall 80 or nested in an opening therethrough and actually disposed in the cooler itself.

Figure 5:
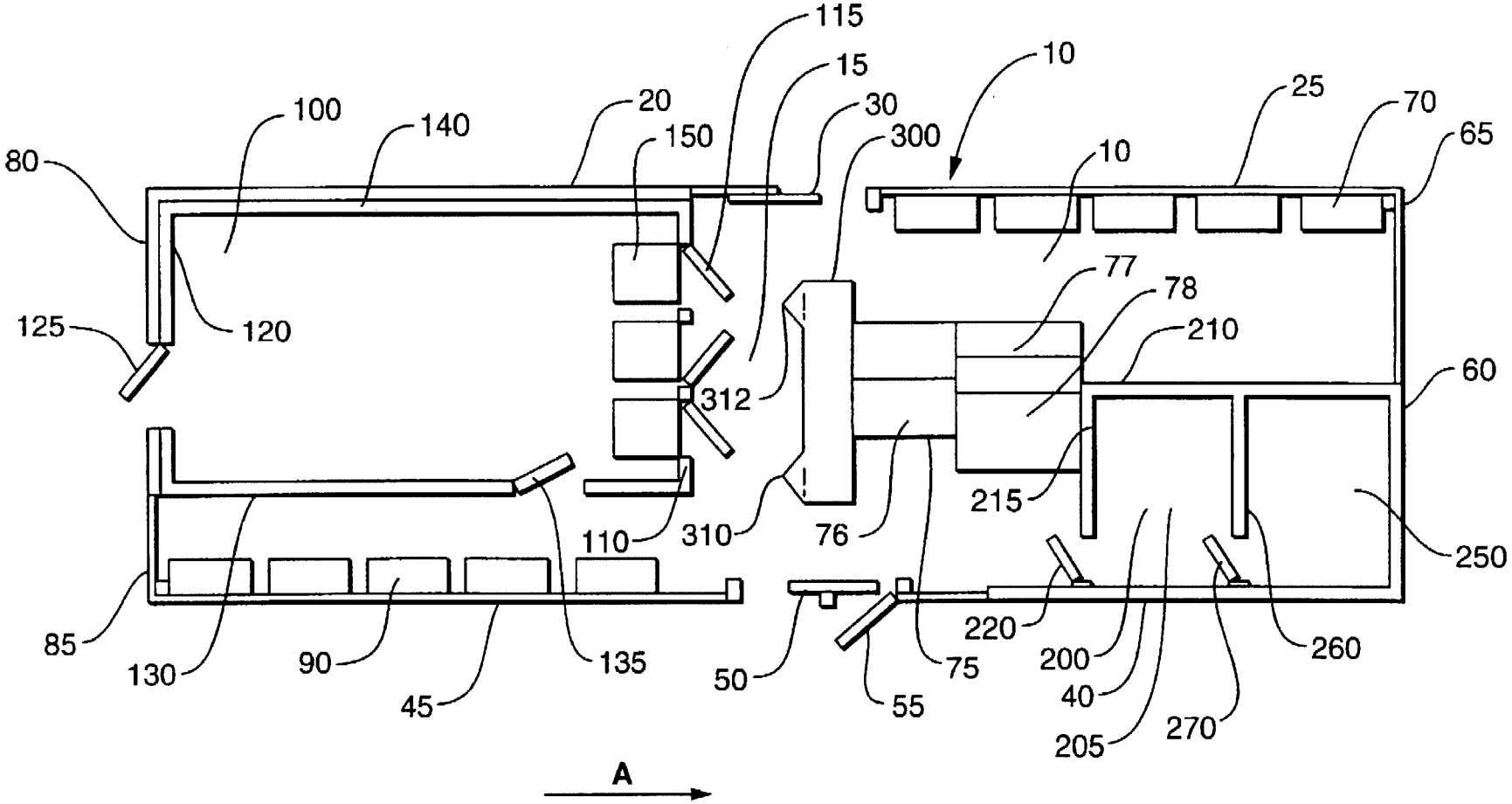
FIG. 5 is a cut-away, top view of an embodiment of the present invention along line 5—5 in FIG. 1.

FIG. 5 shows a top, cut-away view, looking down at the floor 15 of the preferred embodiment of the store 10. As can be seen from this view, it is preferred that the front and rear walls 40, 20 and the right and left walls 60, 80 substantially oppose one another to give the store 10 a rectangular shape.

The front door 50 and rear door 30 are located substantially near the middle of the front wall 40 and the rear wall 20, respectively. For reference, arrows A and B again show the direction customer traffic flows past the front and rear door 50, 30, respectively. Locating the doors 50, 30 thusly allows equally efficient service for each customer lane from a single, central location. In order to minimize the space needed and maximize the display functions, it is preferred that the doors 50, 30 be sliding glass doors. The cashier stand 300, is located substantially in this central location between the front and rear doors 50, 30. The cashier stand 300 can have extensions 310, 312 to allow placement of cash registers (not shown) at an angle, so that the employees can operate the registers while facing generally toward the front or rear doors 50, 30, respectively.

The walk-in cooler 100 is refrigerated by any of a number of means known in the art and located in the corner formed by the intersection of rear and left walls 20, 80. The cooler 100 has a right side 110, left side 120, front side 130, and rear side 140, in the preferred embodiment, the sides 110, 120, 130, 140 of the cooler 100 are separate cooler walls 110, 120, 130, 140. In an alternate embodiment, the rear side 140 and the left side 120 of the cooler 100 could be integral with the rear wall 20 and the left wall 80, as long as the walls 20, 80 are properly insulated.

In the preferred embodiment shown, exterior cooler-service door 125 is disposed in left cooler wall 120. Left wall 80 is provided with a corresponding opening. If the left side 120 of the cooler 100 were integral with the left wall 80, the exterior cooler-service door 125 would be disposed in the left wall 80. Deliveries of goods, especially short-life refrigerated items which need to be delivered frequently, to the store 10 can be made through the exterior cooler service-door 125. The exterior cooler-service door 125 could alternatively be located in the rear side 140 of the cooler 100, but this would necessitate delivering goods across the customer service lanes which run along the front and rear walls 40, 20. By locating the exterior cooler-service door 125 as shown, deliveries can be made without interfering with the normal flow of customer traffic.

At least one cooler-product door 115 is disposed in the right cooler wall 110. Cooler racks 150 are just inside the cooler 100 behind the cooler-product doors 115. A full selection of refrigerated goods is stocked on the cooler racks 150 for quick access through the cooler-product doors 115. This minimizes the time it takes to fill a customer order. Refrigerated goods are stored in bulk in the remainder of the cooler 100. As the stock on the cooler racks 150 is depleted, replacement goods are "rotated" from the cooler 100.

The right cooler wall 110 should be as far from the left cooler wall 120 as possible to maximize cooler capacity. At the same time, it should be spaced far enough from the cashier stand 300 to allow the cooler-product doors 115 to be opened and not interfere with efficient operation. The optimum spacing of the right cooler wall 110, the cashier stand 300 and the front door 50 would allow each to fall near the perimeter of a single imaginary circle having a diameter of approximately five feet. The cooler-product doors 115 should be hinged to avoid swinging into this circle as well. This allow employees enough room to move freely while minimizing the distances they must cover.

The interior cooler-service door 135 provides access to the cooler 100 from the interior of the store 10. The interior cooler-service door 135 may be located anywhere along the front or right cooler walls 130, 110. In order to minimize the width of the cooler 100, it is desired that the cooler-service door 135 be in the front cooler wall 130. If the interior cooler-service door 135 is to open into the cooler 100, as shown, then it should be far enough from the right cooler wall 110 to avoid the cooler racks 150 when opened. Locating it as close to the right cooler wall 110 as possible allows for more efficient operation. It minimizes the distance an employee must travel to reach goods inside the cooler 100. Also, because a path must be clear for the interior cooler-service door 135 to swing, it prevents the stacking of goods directly next to the cooler racks 150, which would slow the rotation of goods to the cooler racks 150.

Front cooler wall 130 is spaced from front wall 40. This serves several purposes which improve the operation of the store 10. First, it allows the interior cooler-service door 135 to be disposed in the front cooler wall 130 and the right cooler wall 110 to be devoted almost entirely to cooler product doors 115, the benefits of which have been discussed. Second, it allows front display window 45 to be disposed in the front wall 40, and front display racks 90 to be disposed against front display windows 45.

Non-refrigerated goods are displayed on the front display racks 90 through the front display windows 45. In order to minimize the space taken by the front display racks 90, they can be configured to fit between the mullions separating the windowpanes 45. To maximize cooler capacity, front cooler wall 130 should be as close to the front wall 40 as possible. However, there should be sufficient space between the cooler 100 and the front wall 40 so that, when the front display racks 90 are in place against the front display windows 45, there is sufficient space to stock and retrieve items efficiently from the front display racks 90. Therefore, the distance the cooler 100 needs to be from the front wall 40 will depend upon the distance the front display racks 90 extend into the store 10 from the front display windows 45. If it is desired to meet the present standards set by the ADA, three feet of clearance should be provided between the front display racks 90 and the front cooler wall 130.

An employee room 200 is positioned in the corner formed by the intersection of front wall 40 and the right wall 60. A manager area 205 and a restroom 250 are within the employee room 200. A rear employee-room wall 210 and a left employee-room wall 215 segregate the employee room 200 from the remainder of the interior of the store. An employee-room door 220 provides access to the employee room 200. A restroom wall 260 separates a restroom 250 from manager area 205, and a restroom door 270 provides passage therebetween.

The restroom 250 contains all standard equipment and fixtures (not shown) in any of numerous configurations, such as a toilet, sink, grab bars, soap dispenser, tissue dispenser, hand dryer towel dispenser and mirror. It is preferred that the size of doors 220, 270 and area of the restroom 260 be sufficient to permit wheelchair access under specifications set by the ADA.

The manager area 205 contains several standard items (not shown) as well, such as a desk, shelves, lock boxes for storage of valuable items (such as cigarettes) and mop sink.

This configuration of the employee room 200 is preferred but not necessary. For instance, the doors 220, 270 could be disposed differently. Either or both doors 220, 270 could be located in rear employee-room wall 210. It is not vital that there be access directly between the manager area 205 and restroom 250.

Another alternative configuration could eliminate left employee-room wall 215 and shorten rear employee-room wall 210 so that manager area 205 would not be enclosed. However, it is preferred that manager area 205 be enclosed because it improves the aesthetics of the store 10 and provides an out-of-sight area for tasks that, for security or other reasons, should not be done in plain sight.

Rear employee-room wall 210 is spaced from rear wall 20. This allows rear display windows 25 to be disposed in the rear wall 20, and rear display racks 70 to be disposed against rear display windows 25. The distance the employee room 200 needs to be from the rear wall 20 will depend upon the distance the rear display racks 70 extend into the store 10 from the rear display windows 25, so that there is sufficient space to stock the racks 70, and, if desired, to meet ADA standards.

Between the cashier stand 300 and the employee room 200 is an inventory storage area 75. In area 75 inventory shelving 77 and at least one freezer 76 should be supplied. To improve efficiency, upright freezers 76 are preferred, because employees can retrieve items from them quickly, but any of a number of standard freezer types could be employed. Freezers 76 are placed back-to-back just to the right of the cashier stand 300 to reduce the space needed and facilitate access. Just to the right of the freezers 76 is the inventory shelving 77, for bulk items, and an ice merchandiser 78. It is also preferred that a cigarette dispenser (not shown) be suspended above the cashier stand 300 for easy access.

As the figures show, display windows 25, 45, 65, 85 are disposed in almost all available exterior wall space, except where the cooler 100 and employee room 200 dictate otherwise. This serves many functions. First, from a marketing standpoint, it provides as much display area as possible for displaying merchandise to customers. From an operational standpoint, it allows the customers to watch the employees filling orders, which will encourage efficiency from the employees and keep customers' attention while they wait in line. From a safety standpoint, it provides a view of the majority of the store 10 from a distance, and allows the interior lights to illuminate the nearby surroundings, creating a safer environment for both employees and customers. Safety is further increased by providing ample exterior lighting, especially on the underside of the canopies 450, 452. In addition, for late-night transactions, "security pass-throughs" (not shown) could be provided next to front and rear doors 50, 30. This could be any acceptable mechanism which would allow passage of a small bag of groceries in a secure manner while shielding employees, and would allow the doors 50, 30 to remain closed and locked.

In the preferred embodiment, the store 10 is rectangular in shape. However, this is not necessary to the invention. For example, the portion of the left wall 80 between the cooler 100 and the front wall 40 could be angled inward, creating an additional short wall "cutting" the corner off the building. Left display window 85 could be disposed in the new angled wall portion. A similar alteration could be made to the design at the other end of the store, at the portion of the right wall 60 between the employee room 200 and the rear wall 20.

In the preferred embodiment, the entire store 10 is constructed as a modular unit. Materials and means generally known in the art are used to manufacture the store 10 away from its ultimate use site. Items such as the display racks 70, 90, the cooler racks 150, the freezers 76, and the inventory shelving 77 may be either affixed in position at manufacture, or installed at the site. In order to facilitate shipment of the store 10, the canopies 450, 452 can be installed once the store 10 has been delivered to the site. At the site, the foundation is laid and exterior plumbing, telephone, and electrical hook-ups are readied prior to the delivery of the store 10.

In order to maintain a proper inventory, it is desired that the cooler 100 have a horizontal area of approximately one hundred eighty square feet. However, as a modular unit, the preferred embodiment of the store 10 is subject to certain size constraints. If it is desired that the store 10 be delivered via truck on the highway, current regulations require that the entire store 10 be no wider than fourteen feet. This places serious constraints on the design of the store. In order to fit such a large cooler 100 into such a narrow space, and allow sufficient room for display racks 90 and windows 45, the cooler 100 must be elongated in shape.

There is another advantage to having a cooler 100 with this elongated shape, regardless of whether it is used in a prefabricated, modular store, or a conventional site-built store. With less space between front and rear cooler walls 130, 140, there is less room for stacking rows of refrigerated goods in front of one another along these walls. Because there are fewer rows, less time will be spent finding and retrieving goods from behind other goods, thereby increasing the efficiency of rotation of inventory to the cooler racks 150.

The preferred embodiment takes on the following dimensions. Front and rear walls 40, 20 are approximately fifty-four feet long. Left and right walls 80, 60 are slightly under fourteen feet long. The cooler 100 is approximately twenty-two feet long and approximately eight and two-thirds feet wide. Employee room 200 is approximately eight and two-thirds feet from front wall 40 to rear employee-room wall 210. The restroom 250 is slightly under six feet from right wall 60 to restroom wall 260. Manager area 205 is approximately seven feet from restroom wall 260 to left employee-room wall 215.

Figure 8:
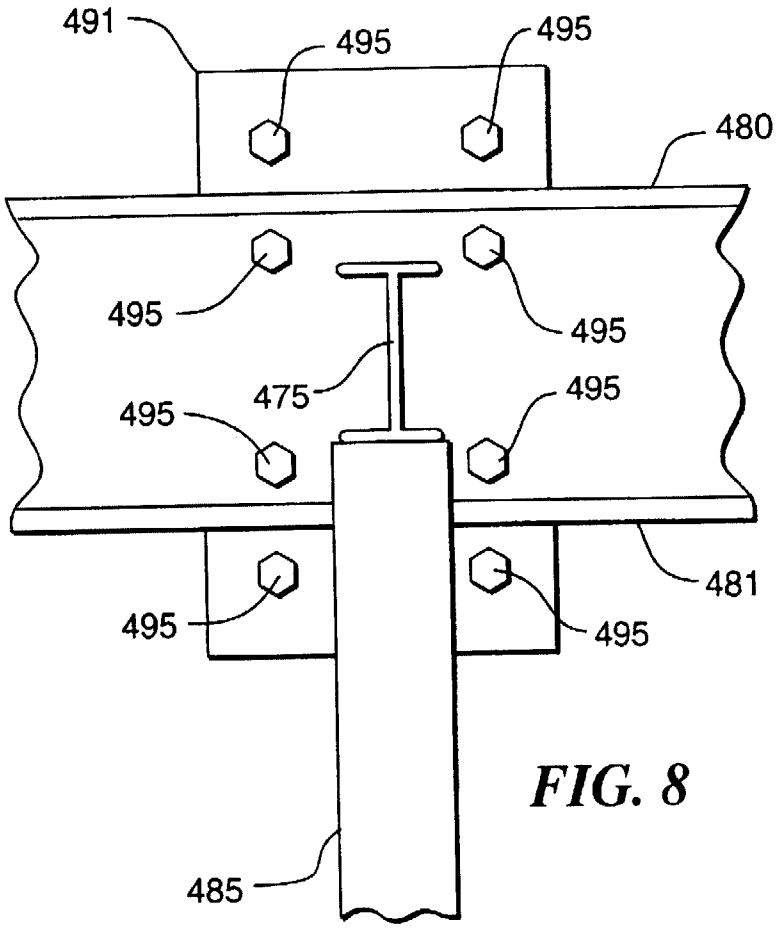
FIG. 8 is a cut-away view illustrating the canopy installation along line 8—8 in FIG. 6.

Once the modular store 10 is delivered and anchored by conventional means, the canopies 450 and 452 are installed, if they are not already attached. This can be done by means known in the art, an example of which is shown in FIGS. 6–8.

Figure 6:
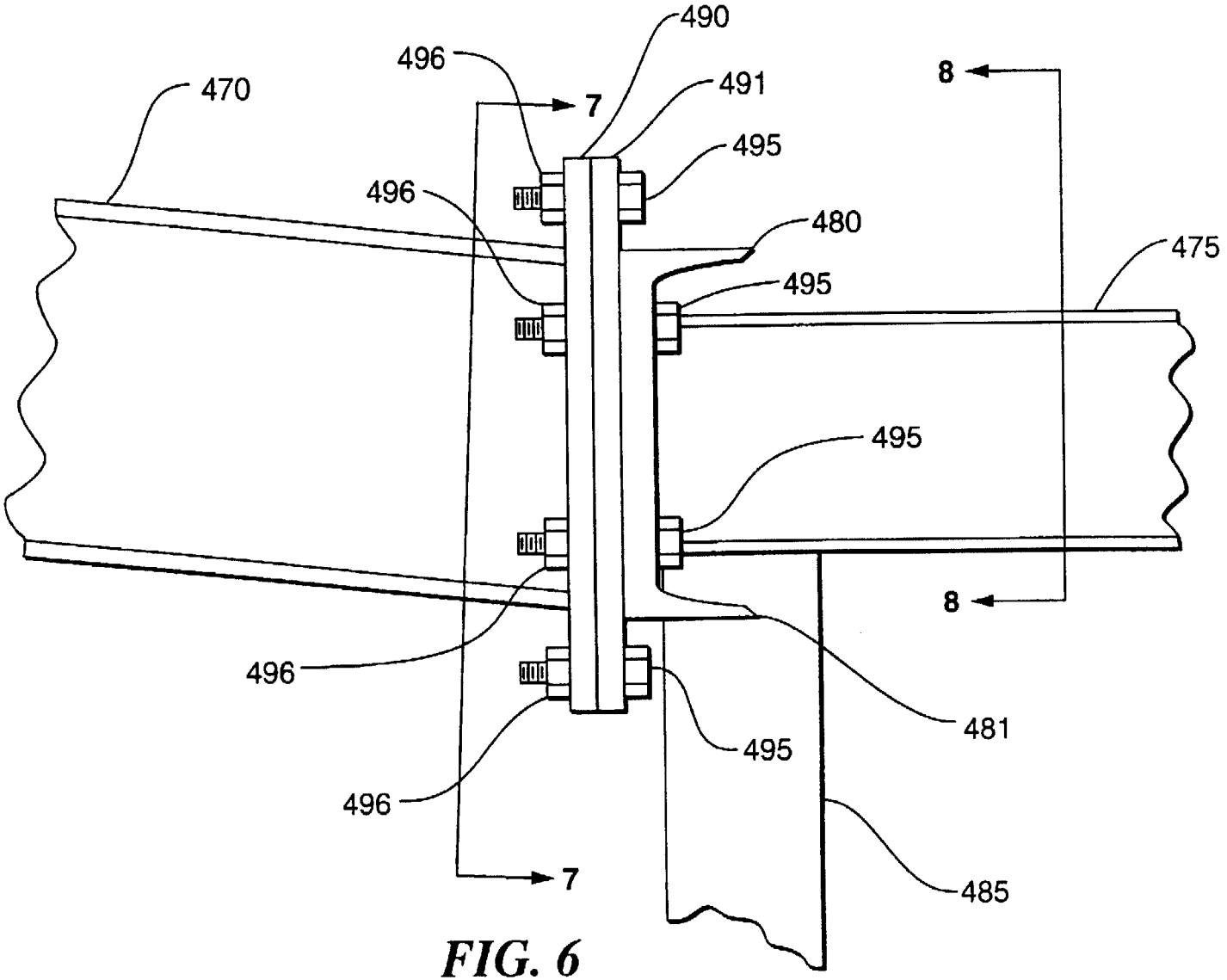
FIG. 6 is a cut-away view illustrating the canopy installation along line 6—6 in FIG. 2.

FIG. 6 shows a vertical column 485 supporting a horizontal roof I-beam 475 as part of the main structure of store 10. A channel form 480 is bonded by conventional means to roof I-beam 475. Similarly, a canopy I-beam 470 is bonded to plate 490. To secure the canopies 450, 452 to the store 10, plates 490, 491, and channel form 480 are bonded and bolted together in sequence as shown, by using bolts 495 and nuts 496. It can be seen that the canopy I-beam 470 is bonded to the plate 490 at an angle. This provides the canopies 450, 452 with their angle best seen in FIGS. 3 and 4. In the figures, canopies 450, 452 are shown sloping up away from the store 10. In actual practice, the canopies 450, 452 may be disposed at any desired angle.

Figure 7:
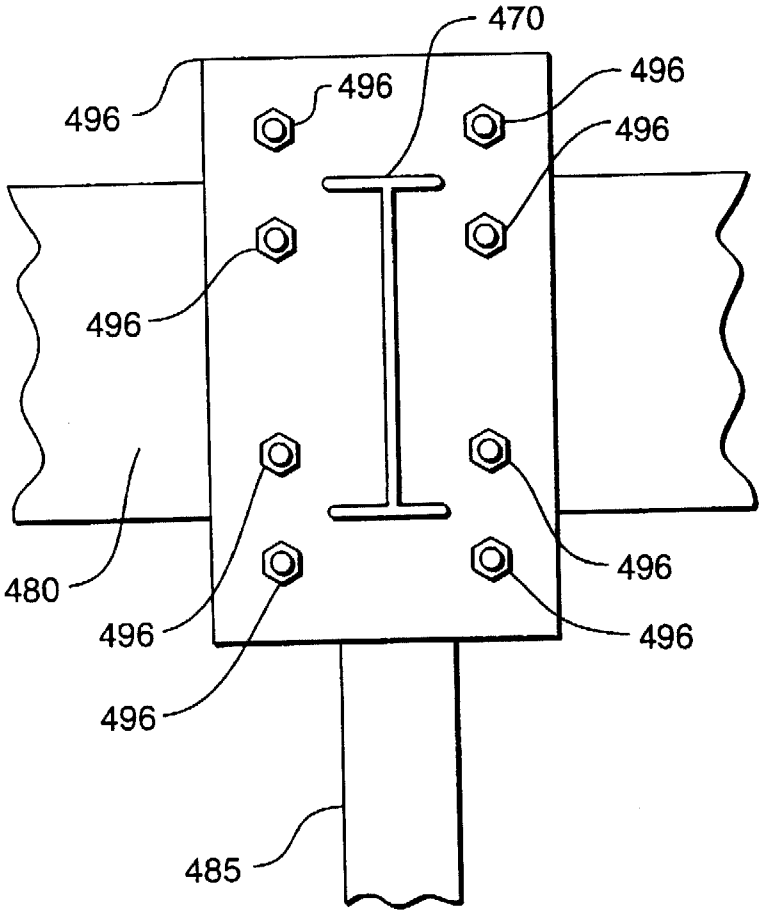
FIG. 7 is a cut-away view illustrating the canopy installation along line 7—7 in FIG. 6.

FIG. 7 shows the attachment of the canopies 450, 452 from a different perspective, shown by line 7—7 in FIG. 6. The distribution of the nuts 496 about canopy I-beam 470 can be seen better from this view. FIG. 8 is the opposite view, shown by line 8—8 in FIG. 6. This shows the bolts 495, which are mated with the nuts through plates 490, 491, and in some cases through channel form 480. As can be seen from this figure and FIG. 6, column 485 passes through a gap in a lower flange 481 of channel form 480.

A series of canopy I-beams 470 is cantilevered along the roofline of the store 10 in this fashion to form the support for the canopy. The number of canopy I-beams 470 that must be used depends upon the length the canopy 450 (or 452) is desired to be. After the canopy I-beams 470 are in place, any desired form of cover (not shown) can be fastened to them to form the "ceiling" of the canopy; for example, deck pan can be used.

Accordingly, it will be understood that the preferred embodiment of the present invention has been disclosed by way of example and that other modifications and alterations may occur to those skilled in the art without departing from the scope and sphere of the appended claims.

What is claimed is:

1. A modular convenience store comprising:

a floor;

a plurality of walls extending substantially vertically from said floor and defining a non-circular perimeter of said store, said store having an interior and an exterior;

a roof covering said interior of said store;

a plurality of vehicle drive-thru lanes substantially adjacent to said store;

a plurality of access doors located within said walls for ingress to and egress from said interior of said store, wherein said access doors are substantially adjacent to said vehicle drive-thru lanes, whereby a driver of a vehicle in one of said vehicle drive-thru lanes and adjacent one of said access doors may communicate with an employee of said store without said driver exiting said vehicle and entering said store;

a walk-in cooler having an interior, said cooler being located within said interior of said store adjacent at least one of said wall;

an exterior cooler-service door for passage between said exterior of said store and said interior of said cooler whereby the cooler may be accessed throught the exterior cooler-service door by a person on the exterior of the store without entering the interior of the store or communicating with an employee of the store;

an interior cooler-service door for passage between said interior of said cooler and said interior of said store; and at least one display window disposed within at least one of said walls;

whereby said walls, roof, doors and coolers are modular, such that said store may be assembleable off-site and transportable as a single unit, and whereby said walls and said roof, once assembled, are stationary.

2. The convenience store of claim 1, wherein said plurality of walls includes a front wall; a rear wall; a left wall; and a right wall.

3. The convenience store of claim 2, wherein said front and rear walls substantially oppose one another, and said left and right walls substantially oppose one another, so that said store is substantially rectangular in shape.

4. The convenience store of claim 3, wherein said:access doors comprise a front access door located substantially intermediate the sides of said front wall and a rear access door located substantially intermediate the sides of said rear wall.

5. The convenience store of claim 4, wherein said cooler is located left of said rear access door and spaced from said front wall.

6. The convenience store of claim 5 wherein said cooler is adjacent said rear and left walls.

7. The convenience store of claim 6, wherein said cooler further comprises:

a front side substantially parallel to and spaced apart from said rear and front walls;

a right side substantially parallel to and spaced apart from said left and right walls;

a left side adjacent said left wall; and a rear side adjacent said rear wall.

8. The convenience store of claim 7, wherein said front side substantially opposes said rear side and said right side substantially opposes said left side so that said cooler is substantially rectangular.

9. The convenience store of claim 8, wherein said exterior cooler-service door is disposed within said left side of said cooler.

10. The convenience store of claim 9, further comprising a cooler-product door in said right side of said cooler.

11. The convenience store of claim 10, wherein:

said display windows include a front display window disposed within said front wall to the side of said front access door and a rear display window disposed within said rear wall to the side of said rear access door.

12. The convenience store of claim 11, further comprising:

an employee room within said interior of said store adjacent said front and right walls, said employee room being located right of said front access door, said employee room being spaced from said rear wall; and a restroom within said employee room.

13. The convenience store of claim 2, wherein said access doors comprise a front access door located substantially intermediate the sides of said front wall and a rear access door located substantially intermediate the sides of said rear wall.

14. The convenience store of claim 13, wherein said cooler is located left of said rear access door and spaced from said front wall.

15. The convenience store of claim 14 wherein said cooler is adjacent said rear and left walls.

16. The convenience store of claim 15, wherein said cooler further comprises:

a front side substantially parallel to and spaced apart from said rear and front walls;

a right side substantially parallel to and spaced apart from said left and right walls;

a left side adjacent said left wall; and a rear side adjacent said rear wall.

17. The convenience store of claim 16, wherein said front side substantially opposes said rear side and said right side substantially opposes said left side so that said cooler is substantially rectangular.

18. The convenience store of claim 17, wherein said exterior cooler-service door is disposed within said left side of said cooler.

19. The convenience store of claim 18, further comprising a cooler-product door in said right side of said cooler.

20. The convenience store of claim 19, wherein:

said display windows include a front display window disposed within said front wall to the side of said front access door and a rear display window disposed within said rear wall to the side of said rear access door.

21. The convenience store of claim 20, further comprising:

an employee room within said interior of said store adjacent said front and right walls, said employee room being located right of said front access door, said employee room being spaced from said rear wall; and a restroom within said employee room.

22. The convenience store of claim 16, wherein said exterior cooler-service door is disposed within said left side of said cooler.

23. The convenience store of claim 22, further comprising a cooler-product door in said right side of said cooler.

24. The convenience store of claim 23, wherein said display windows include a front display window disposed within said front wall to the side of said front access door and a rear display window disposed within said rear wall to the side of said rear access door.

25. The convenience store of claim 24, further comprising:

an employee room within said interior of said store adjacent said front and right walls, said employee room being located right of said front access door, said employee room being spaced from said rear wall; and a restroom within said employee room.

26. The convenience store of claim 14, wherein said cooler further comprises:

a front side substantially parallel to and spaced apart from said rear and front walls;

a right side substantially parallel to and spaced apart from said left and right walls;

a left side; and a rear side.

27. The convenience store of claim 26, wherein said exterior cooler-service door is disposed within said left side of said cooler.

28. The convenience store of claim 27, further comprising a cooler-product door in said right side of said cooler.

29. The convenience store of claim 28, wherein said display windows include a front display window disposed within said front wall to the side of said front access door and a rear display window disposed within said rear wall to the side of said rear access door.

30. The convenience store of claim 29, further comprising:

an employee room within said interior of said store adjacent said front and right walls, said employee room being located right of said front access door, said employee room being spaced from said rear wall; and a restroom within said employee room.

31. The convenience store of claim 30, wherein said exterior cooler-service door is disposed within said left side of said cooler.

32. The convenience store of claim 31, further comprising a cooler-product door in said right side of said cooler.

33. The convenience store of claim 32, wherein said display windows include a front display window disposed within said front wall to the side of said front access door and a rear display window disposed within said rear wall to the side of said rear access door.

34. The convenience store of claim 33, further comprising:

an employee room within said interior of said store adjacent said front and right walls, said employee room being located right of said front access door, said employee room being spaced from said rear wall; and a restroom within said employee room.

35. The convenience store of claim 12, further comprising cooler racks in said interior of said cooler adjacent said cooler product doors.

36. The convenience store of claim 35, wherein said front and rear access doors are sliding glass doors.

37. The convenience store of claim 36, further comprising:

a left display window located in said left wall between said cooler and said front wall; and a right display window located in said right wall between said employee room and said rear wall.

38. The convenience store of claim 37, wherein:

said front display window occupies substantially all of said front wall left of said front access door;

said rear display window occupies substantially all of said rear wall right of said rear access door;

said left display window occupies substantially all of said left wall between said cooler and said front wall; and said right display window occupies substantially all of said right wall between said employee room and said rear wall.

39. The convenience store of claim 38, further comprising:

a cashier stand located within said interior of said store spaced from, and substantially intermediate the interior space between, said front and rear access doors, said stand being located right of and spaced from said cooler; and an inventory storage area located right of said cashier stand and left of said employee room.

40. The convenience store of claim 39, further comprising:

front display racks adjacent said front and left display windows for displaying merchandise to said exterior of said store through said front and left display windows; and rear display racks adjacent said rear and right display windows for displaying merchandise to said exterior of said store through said rear and right display windows;

wherein said cooler is spaced from said front wall sufficiently to allow stocking of said front display racks;

wherein said employee room is spaced from said rear wall sufficiently to allow stocking of said rear display racks.

41. The convenience store of claim 40, further comprising a freezer located within said inventory storage area.

42. The convenience store of claim 41, further comprising inventory shelving located within said inventory storage area.

43. The convenience store of claim 42, further comprising a front canopy and a rear canopy extending from said roof over said front and rear access doors, respectively.

44. The convenience store of claim 43, wherein said left and right walls are less than twenty feet long.

45. The convenience store of claim 44, wherein said left and right walls are less than or equal to fourteen feet long.

46. The convenience store of claim 45, wherein said front and rear walls are less than sixty-five feet long.

47. The convenience store of claim 46, wherein said front and rear walls are less than or equal to fifty-five feet long.

48. The convenience store of claim 47, further comprising an exit-only panic door through said front wall located between said front access door and said employee area.

49. A modular convenience store comprising:

a floor;

a plurality of walls extending substantially vertically from said floor and defining a non-circular perimeter of said store, said store having an interior and an exterior; said plurality of walls including a front wall, a rear wall, a left wall, and a right wall;

said front wall being less than or equal to sixty feet long;

said rear wall being less than or equal to sixty feet long and substantially opposing said front wall;

said left wall being less than or equal to fourteen feet long;

said right wall being less than or equal to fourteen feet long and substantially opposing said left wall;

a roof covering said interior of said store;

a front access door located substantially intermediate the sides of said front wall, wherein said front access door is substantially adjacent to a first vehicle drive-thru lane, whereby a driver of a vehicle in said vehicle drive-thru lane and adjacent said front access door may communicate with an employee of said store without said driver exiting said vehicle and entering said store;

a rear access door located substantially intermediate the sides of said rear wall, wherein said rear access door is substantially adjacent to a second vehicle drive-thru lane, whereby a driver of a vehicle in said vehicle drive-thru lane and adjacent said rear access door may communicate with an employee of said store without said driver exiting said vehicle and entering said store;

a walk-in cooler having an interior, said cooler being located within said interior of said store, left of said rear access door, and spaced from said front wall;

an exterior cooler-service door for passage between said exterior of said store and said interior of said cooler, whereby the cooler may be accessed through the exterior cooler-service door by a person on the exterior of the store without entering the interior of the store or communicating with an employee of the store; and an interior cooler-service door for passage between said interior of said cooler and said interior of said store;

whereby said walls, roof, doors and coolers are modular, such that said store may be assembleable off-site and transportable as a single unit, and whereby said walls and said roof, once assembled, are stationary.

50. A method of constructing a prefabricated, modular, transportable, drive-thru convenience store comprising the steps of:

providing a floor;

providing a plurality of walls to extend from said floor;

connecting said walls to said floor to extend substantially vertically from said floor and define a perimeter of said store, providing said store with an interior and an exterior;

covering said store with a roof for covering said interior of said store;

providing a plurality of vehicle drive-thru lanes substantially adjacent to said storage;

providing a plurality of access doors in said walls for ingress to and egress from said interior of said store, wherein said access doors are constructed to be placed substantially adjacent to said vehicle drive-thru lanes, whereby a driver of a vehicle in one of said vehicle drive-thru lanes and adjacent one of said access doors may communicate with an employee of said store without said driver exiting said vehicle and entering said store;

providing a walk-in cooler having an interior, said cooler being located within said interior of said store adjacent at least one of said walls;

providing an exterior cooler-service door for passage between said exterior of said store and said interior of said cooler, whereby the cooler may be accessed through the exterior cooler-service door by a person on the exterior of the store without entering the interior of the store or communicating with an employee of the store;

providing an interior cooler-service door for passage between said interior of said cooler and said interior of said store;

providing at least one display window disposed within at least one of said walls;

completing all of said foregoing steps at a first location;

transporting said completed store as a single unit to a second location; and placing said completed store in a desired spot at said second location;

whereby said walls and said roof of said completed store, once placed in said desired spot, are stationary.

* * * * *